US008997722B1

(12) United States Patent
Fowler

(10) Patent No.: US 8,997,722 B1
(45) Date of Patent: Apr. 7, 2015

(54) TUNABLE THROTTLE PLATE

(71) Applicant: Russell D. Fowler, Vermillion, OH (US)

(72) Inventor: Russell D. Fowler, Vermillion, OH (US)

( * ) Notice: Subject to any disclaimer, the term of this patent is extended or adjusted under 35 U.S.C. 154(b) by 22 days.

(21) Appl. No.: 13/943,127

(22) Filed: Jul. 16, 2013

(51) Int. Cl.

| | |
|---|---|
| ***F02M 29/00*** | (2006.01) |
| ***F02B 51/00*** | (2006.01) |
| ***F02M 27/00*** | (2006.01) |
| ***F02M 7/00*** | (2006.01) |

(52) U.S. Cl.
CPC ..... *F02M 7/00* (2013.01)

(58) Field of Classification Search
CPC ..... F02M 35/10177; F02M 35/1021; F02M 25/0836; F02M 69/044; F02M 19/03; F02M 19/04; F02M 35/10; F02M 3/10; F02M 5/125; F02M 61/145; F02M 61/1833; F02M 61/1853; F02M 69/00; F02M 69/046; F02M 7/133; F02B 23/101; F23R 2900/00012; F23R 3/002; F23R 3/286; F23R 3/42
USPC ..... 123/585, 590, 531, 536, 537, 1 A
See application file for complete search history.

(56) References Cited

U.S. PATENT DOCUMENTS

| | | | | | |
|---|---|---|---|---|---|
| 1,480,032 | A * | 1/1924 | Thrill | 48/189.3 |
| 3,857,375 | A * | 12/1974 | Jackson | 123/587 |
| 4,355,623 | A * | 10/1982 | Graham | 123/585 |
| 5,223,180 | A * | 6/1993 | Yost | 261/41.1 |
| 5,743,241 | A * | 4/1998 | Wood et al. | 123/531 |
| 5,839,418 | A * | 11/1998 | Grant | 123/585 |
| 5,967,099 | A * | 10/1999 | Patrick | 123/1 A |
| 6,269,805 | B1 * | 8/2001 | Wilson | 123/585 |
| 6,279,557 | B1 * | 8/2001 | Fischer et al. | 123/585 |
| 6,371,095 | B1 * | 4/2002 | Sacarto | 123/590 |
| 6,378,512 | B1 * | 4/2002 | Staggemeier | 123/585 |
| 6,561,172 | B1 * | 5/2003 | Chestnut et al. | 123/585 |
| 6,691,688 | B1 * | 2/2004 | Chestnut | 123/585 |
| D492,888 | S | 7/2004 | Wilson | |
| 6,955,163 | B2 * | 10/2005 | Grant | 123/585 |
| 7,533,661 | B2 * | 5/2009 | Baasch | 123/585 |

* cited by examiner

*Primary Examiner* — Marguerite McMahon
*Assistant Examiner* — Tea Holbrook

(57) ABSTRACT

A tunable throttle plate for customizing fuel delivery to a supercharged engine includes a plate that may be coupled to intake manifold of an engine. A fuel aperture extends through the plate. A spray rod is coupled to the fuel aperture. A fuel nozzle is coupled to the spray rod. The fuel nozzle delivers a fuel to the plate through the spray rod. A solenoid is coupled to the fuel nozzle. The solenoid is coupled to a fuel source so the solenoid delivers the fuel to the fuel nozzle.

15 Claims, 6 Drawing Sheets

10
32
24
12

30
14
16

TUNABLE THROTTLE PLATE

BACKGROUND OF THE DISCLOSURE

Field of the Disclosure

The disclosure relates to tunable throttle devices and more particularly pertains to a new tunable throttle device for customizing fuel delivery to a supercharged engine.

SUMMARY OF THE DISCLOSURE

An embodiment of the disclosure meets the needs presented above by generally comprising a plate that may be coupled to intake manifold of an engine. A fuel aperture extends through the plate. A spray rod is coupled to the fuel aperture. A fuel nozzle is coupled to the spray rod. The fuel nozzle delivers a fuel to the plate through the spray rod. A solenoid is coupled to the fuel nozzle. The solenoid is coupled to a fuel source so the solenoid delivers the fuel to the fuel nozzle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
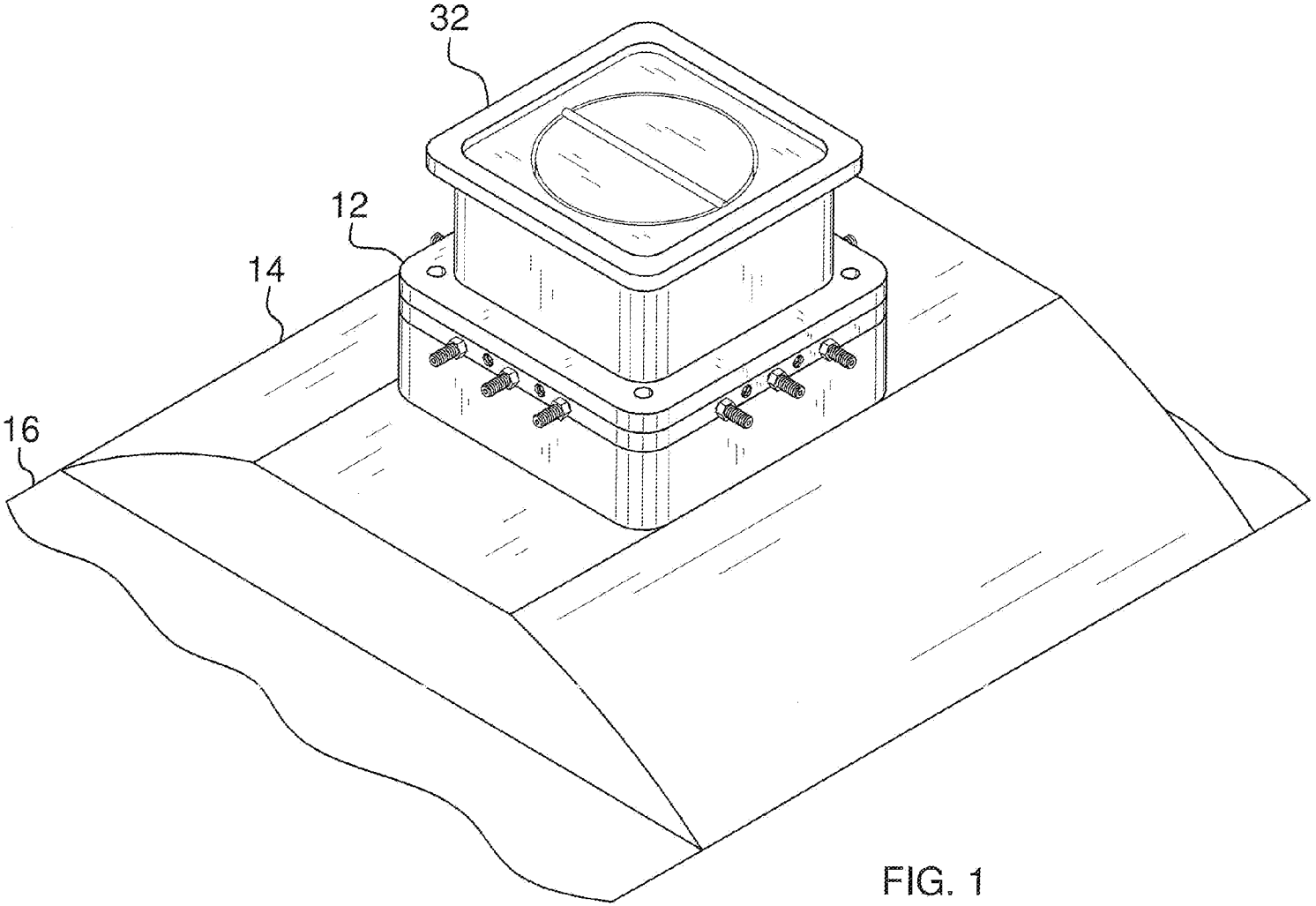
FIG. 1 is an in-use view of a tunable throttle plate according to an embodiment of the disclosure.
Figure 2:
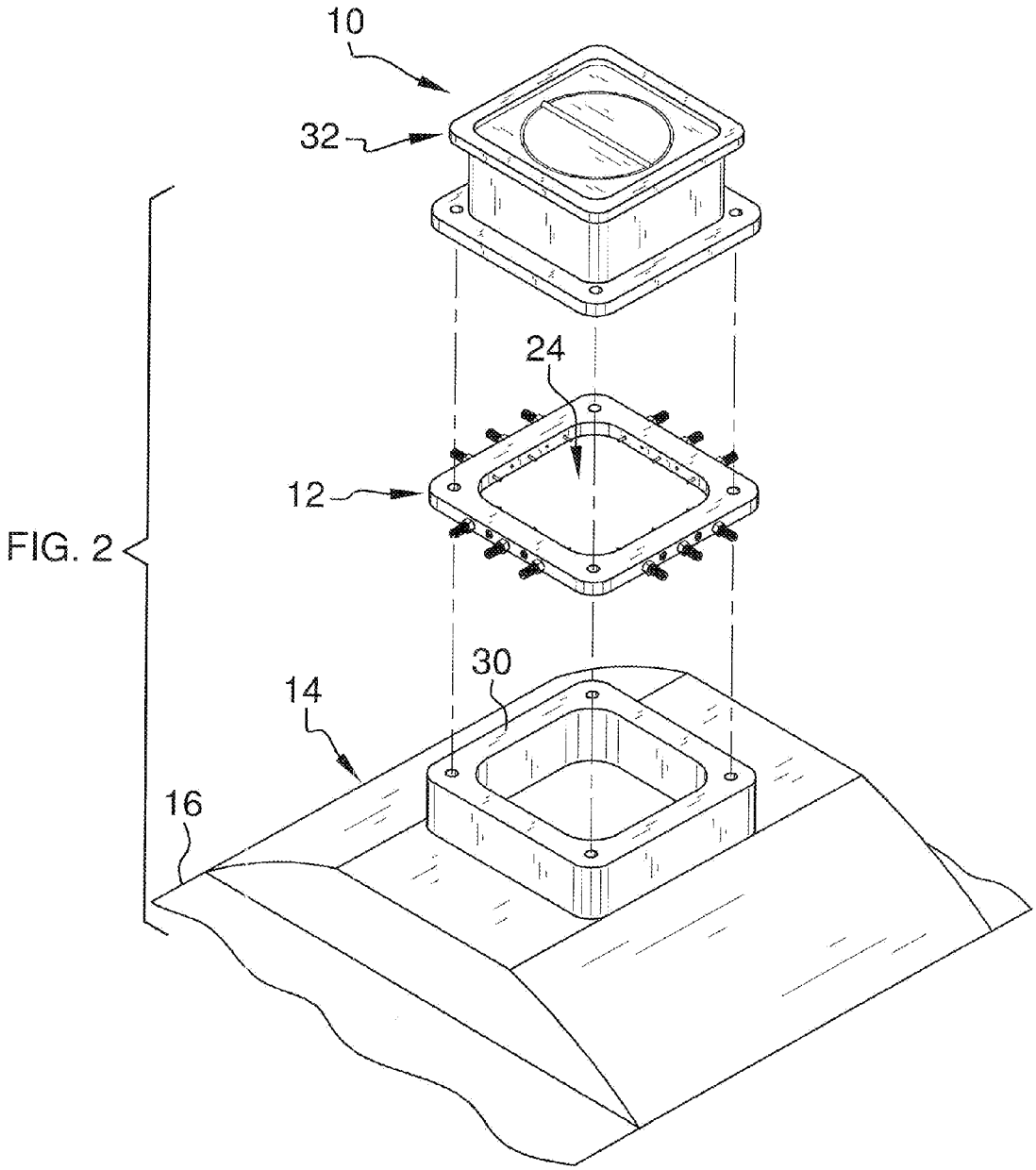
FIG. 2 is a top perspective view of an embodiment of the disclosure.
Figure 3:
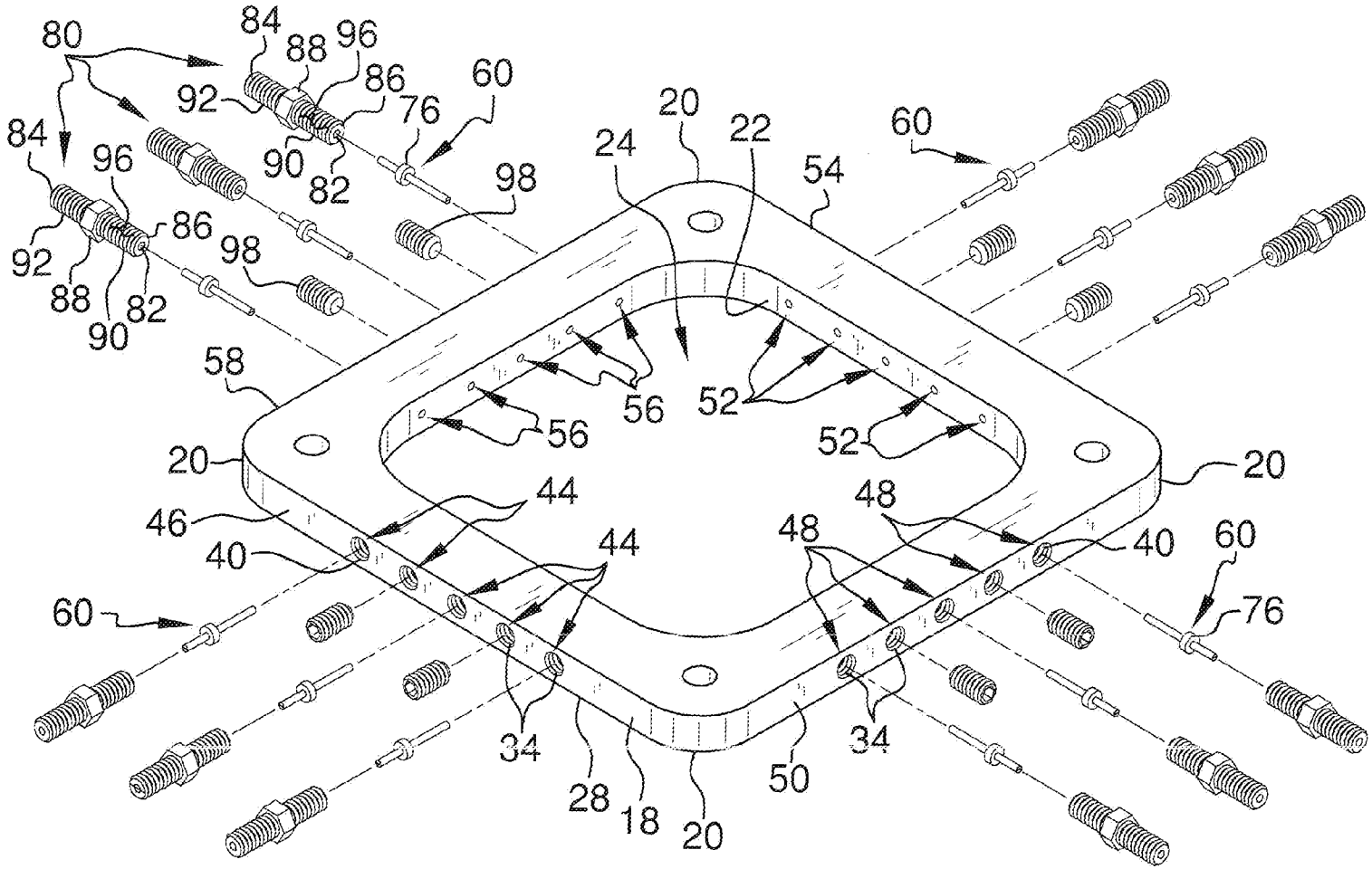
FIG. 3 is an exploded perspective view of an embodiment of the disclosure.
Figure 4:
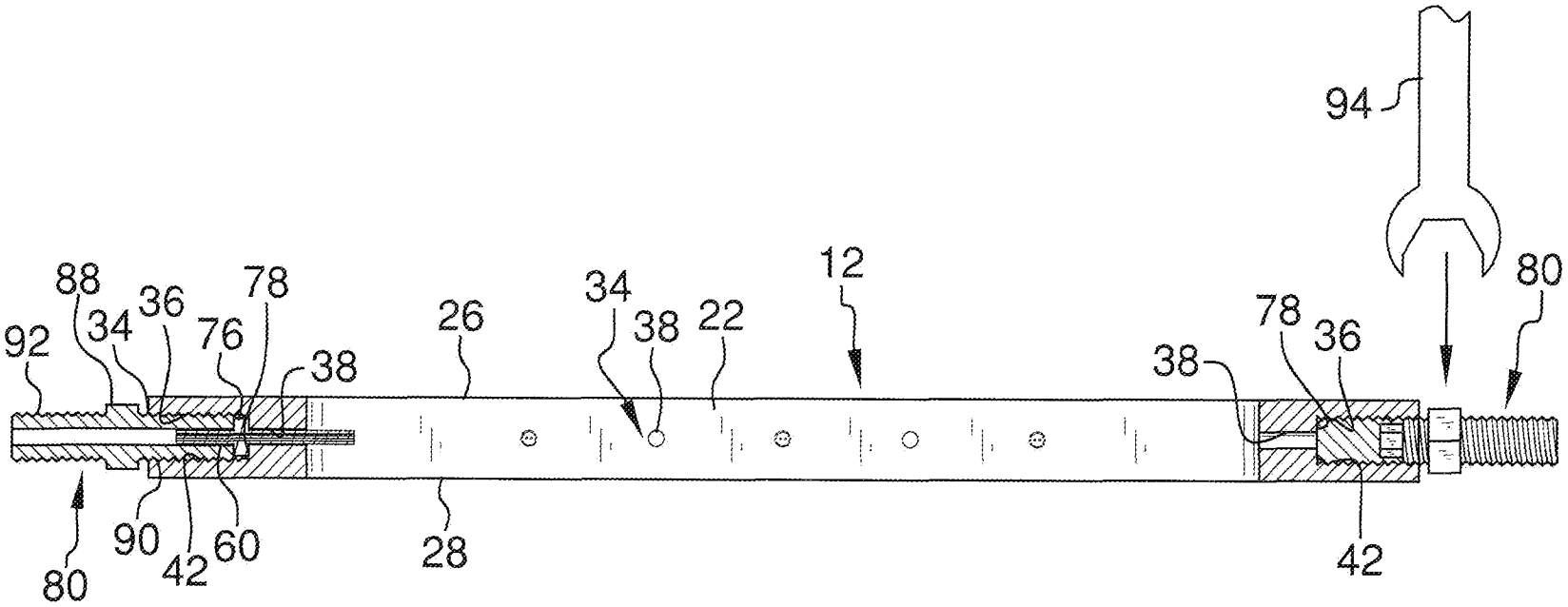
FIG. 4 is a cut away right side view of an embodiment of the disclosure.
Figure 5:
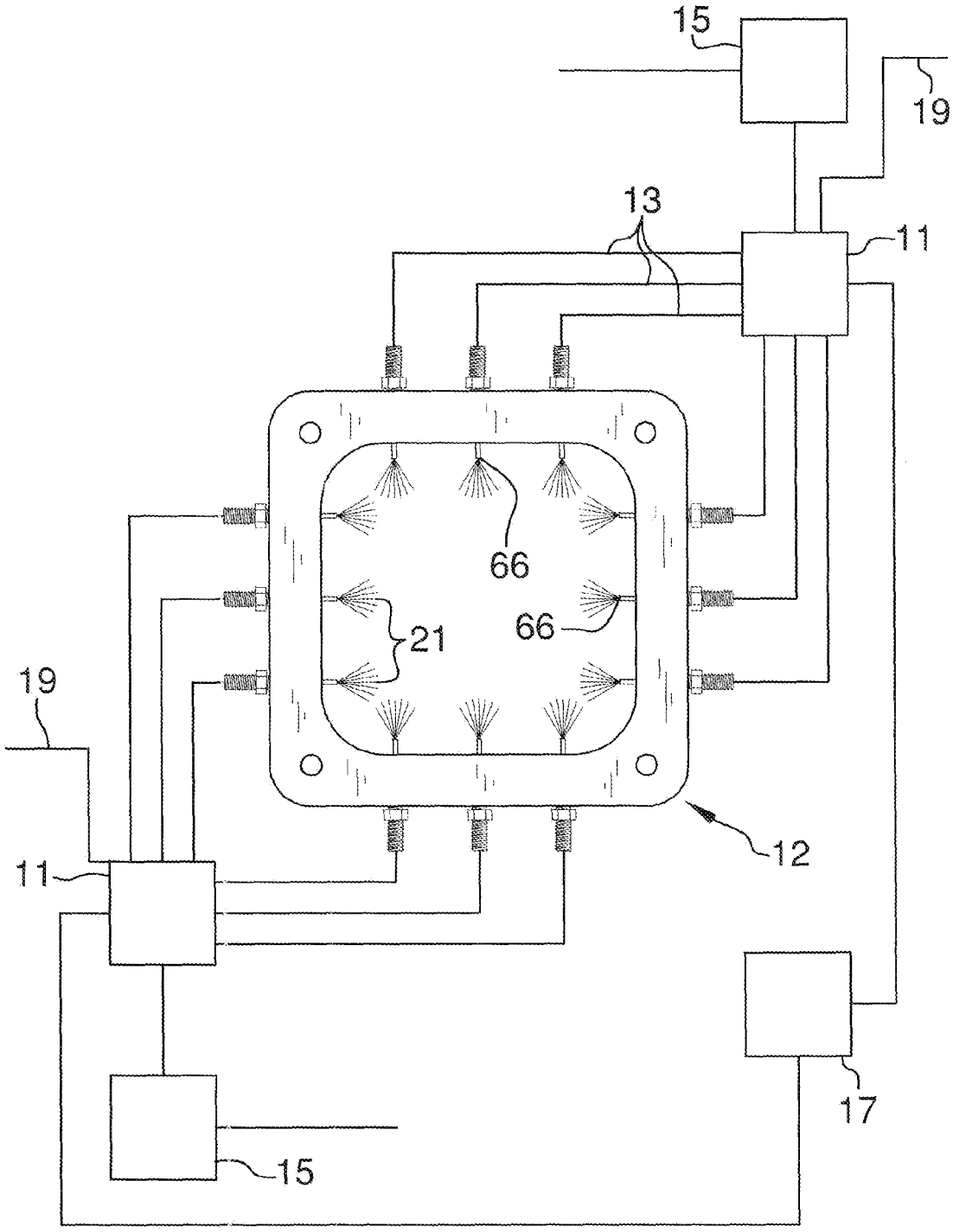
FIG. 5 is a schematic view of an embodiment of the disclosure.
Figure 6:
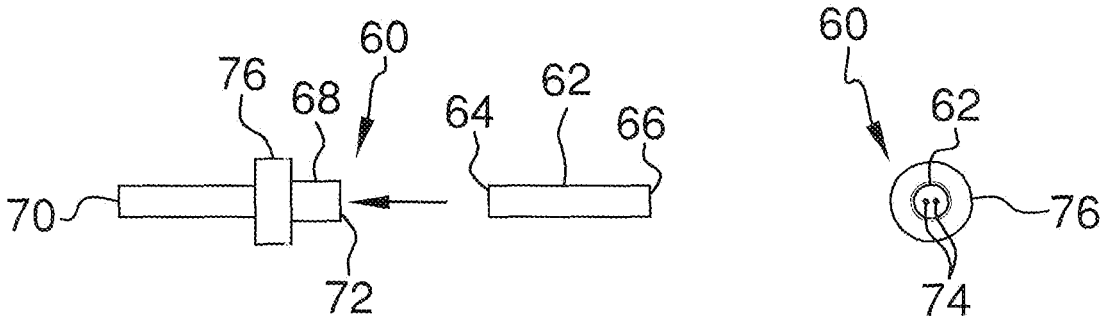
FIG. 6 is a top view of an embodiment of the disclosure.

With reference now to the drawings, and in particular to FIGS. 1 through 6 thereof, a new tunable throttle device embodying the principles and concepts of an embodiment of the disclosure and generally designated by the reference numeral 10 will be described.

As best illustrated in FIGS. 1 through 6, the tunable throttle plate 10 generally comprises a plate 12 that may be coupled to an intake manifold 14 of an engine 16. The engine 16 may be an internal combustion engine of any conventional design. Additionally, the intake manifold 14 may be a supercharger of any conventional design. An outside edge 18 of the plate 12 has four corners 20 so the plate 12 has a square shape. The plate 12 may have a width and a length between 12 cm and 20 cm and a thickness between 1 cm and 2 cm.

An inside edge 22 of the plate 12 defines an intake opening 24 extending through a top side 26 and a bottom side 28 of the plate 12. Moreover, the inside edge 22 of the plate 12 is coextensive with the outside edge 18 of the plate 12 so the intake opening 24 has a square shape that may have a length and a width between 9 cm and 17 cm. The plate 12 is fluidly coupled to the intake manifold 14 so the bottom side 28 of the plate 12 abuts a top 30 of the intake manifold 14. A carburetor 32 may be fluidly coupled to the top side 26 of the plate 12 so the carburetor 32 is in fluid communication with the intake manifold 14. The carburetor 32 may be of any conventional design.

A fuel aperture 34 extends through the outside edge 18 and the inside edge 22 of the plate 12. An outside portion 36 of the fuel aperture 34 has a diameter that is greater than an inside portion 38 of the fuel aperture 34. Continuing, the outside portion 36 of the fuel aperture 34 may have a diameter between 9 mm and 11 mm. The inside portion 38 of the fuel aperture 34 may have a diameter between 3.5 mm and 5 mm. An inside surface 40 of the outside portion 36 of the fuel aperture 34 comprises threads 42. Additionally, the outside portion 36 of the fuel aperture 34 may have a depth between 9 mm and 10 mm. The threads 42 in the outside portion 36 of the fuel aperture 34 may correspond to ⅛ inch National Pipe Thread sizing.

The fuel aperture 34 is one of a plurality of fuel apertures 34. The plurality of fuel apertures 34 comprises a plurality of sets of fuel apertures 34. Each of the fuel apertures 34 in each of the plurality of sets of fuel apertures 34 may be spaced apart a distance between 15 mm and 18 mm. A first set of the fuel apertures 44 is evenly distributed along a first lateral side 46 of the plate 12. Continuing, a second set of the fuel apertures 48 is evenly distributed along a front side 50 of the plate 12. A third set of the fuel apertures 52 is evenly distributed along a second lateral side 54 of the plate 12. Lastly, a fourth set of the fuel apertures 56 is evenly distributed along a back side 58 of the plate 12.

A spray rod 60 is provided that comprises a tubular jet 62 elongated along a longitudinal axis extending through a first end 64 and a second end 66 of the tubular jet 62. The tubular jet 62 may have a length between 15 mm and 20 mm and a diameter between 4 mm and 5 mm. Continuing, the spray rod 60 further comprises a tubular coupler 68 elongated along a longitudinal axis extending through a first end 70 and a second end 72 of the tubular coupler 68. The tubular coupler 68 may have a length between 20 mm and 25 mm and a diameter between 5 mm and 7 mm.

The tubular coupler 68 insertably receives the tubular jet 62. The first end 64 of the tubular jet 62 is positioned within the tubular coupler 68 and the second end 66 of the tubular jet 62 is positioned outwardly from the second end 72 of the tubular coupler 68. Additionally, the tubular jet 62 may be soldered to the tubular coupler 58 so the tubular jet 62 is retained within the tubular coupler 68. The second end 66 of the tubular jet 62 may comprise a pair of spray apertures 74. Each of the spray apertures 74 may have a diameter between 0.4 mm and 0.5 mm.

The spray rod 60 is one of a plurality of spray rods 60. A selected one of the plurality of spray rods 60 is positionable within a selected one of the plurality of fuel apertures 34. A flared portion 76 of the spray rod 60 abuts an inside wall 78 of the outside portion 36 of the selected one of the plurality of fuel apertures 34. The second end 66 of the tubular jet 62 extends outwardly from the inside portion 38 of the selected one of the plurality of fuel apertures 34 into the intake opening 24 in the plate 12. Any number of the plurality of spray rods 60 may be positioned within the plurality of fuel apertures 34.

A fuel nozzle 80 is provided that comprises a delivery aperture 82 extending through a first end 84 and a second end 86 of the fuel nozzle 80. A central portion 88 of the fuel nozzle 80 has an outside diameter that is greater than an outside diameter of each of a front 90 and a rear 92 portion of the fuel nozzle 80. The central portion 88 of the fuel nozzle 80 may have a hexagonal shape so the central portion of the fuel nozzle 80 may be gripped by a wrench 94. The fuel nozzle 80 may have a length between 1.5 cm and 2.5 cm. Moreover, the front 90 and rear 92 portions of the fuel nozzle 80 may have a diameter that corresponds to ⅛ inch National Pipe Thread sizing.

The fuel nozzle 80 is one of a plurality of fuel nozzles 80. A selected one of the plurality of fuel nozzles 80 is selectively positionable within a selected one of the plurality of fuel apertures 34. Moreover, the number of selected fuel nozzles 80 corresponds to the number of selected spray rods 60. An outside surface 96 of the front portion 90 of the fuel nozzle 80 threadably engages the inside surface 40 of the outside portion 36 of the selected one of the plurality of fuel apertures 34. The selected one of the plurality of fuel nozzles 80 is tightened so the fuel nozzle 80 is retained within the selected one of the plurality of the fuel apertures 34.

The delivery aperture 82 on the selected one of the plurality of fuel nozzles 80 insertably receives the first end 70 of an associated one of the plurality of tubular couplers 68. The flared portion 76 of the associated one of the plurality of spray rods 60 is compressed between the fuel nozzle 80 and the inside wall 78 of the first portion 36 of an associated one of the plurality of fuel apertures 34. Continuing, the selected one of the plurality of spray rods 60 is retained within the associated one of the plurality of the fuel apertures 34 when the corresponding fuel nozzle 80 is tightened in the fuel aperture 34. The fuel nozzle 80 is fluidly coupled to the spray rod 60 when the fuel nozzle 80 and the spray rod 60 are both positioned within the fuel aperture 34.

A plug 98 is provided. The plug 98 is one of a plurality of plugs 98. Continuing, a selected number of the plurality of plugs 98 is positioned within any un-used fuel apertures 34. The plugs 98 selectively seal the un-used fuel apertures 34 to prevent a vacuum leak.

A solenoid 11 is provided that is selectively fluidly coupled to the selected number of the plurality of fuel nozzles 80. The solenoid 11 may be a fuel injection solenoid of any conventional design. A plurality of fuel lines 13 is fluidly coupled between the solenoid 11 and the selected number of the plurality of fuel nozzles 80. Continuing, the solenoid 11 is fluidly coupled to a fuel source 19 so the solenoid 11 selectively delivers fuel 21 to the selected number of the plurality of fuel nozzles 80. The fuel 21 may comprise gasoline or the fuel may comprise nitrous oxide. The fuel 21 is sprayed outwardly from the spray apertures 74 in the second end 66 of the selected number of tubular jets 62.

A fuel pressure switch 15 is fluidly coupled to the solenoid 11. The fuel pressure switch 15 may be of any conventional design. Moreover, the fuel pressure switch 15 actuates the solenoid 11 when the fuel pressure switch 15 detects fuel pressure. The solenoid 11 is one of a plurality of solenoids 11. Additionally, the fuel pressure switch is one of a plurality of fuel pressure switches. Each of the plurality of solenoids 11 may be fluidly coupled to an individual fuel nozzle 80 or a plurality of the fuel nozzles 80. A master switch 17 is provided. The master switch 17 is electrically coupled to each of the plurality of solenoids 11. Lastly, the master switch 11 selectively actuates and de-actuates the plurality of solenoids 11.

In use, a user chooses a selected number of spray rods 60 and fuel nozzles 80. The selected number of spray rods 60 and fuel nozzles 80 are positioned within a selected number of the fuel apertures 34. Further, the selected number of spray rods 60 and fuel nozzles 80 may be utilized in any arrangement with respect to the plurality of sets of fuel apertures 34. A selected number of the plurality of solenoids 11 is fluidly coupled to the selected number of fuel nozzles 80. Moreover, each of the plurality of solenoids 11 selectively delivers fuel 21 to the associated fuel nozzles 80 based on the engine's 16 fuel demands. A maximum amount of fuel 21 is delivered at a high engine RPM. A minimum amount of fuel 21 is delivered at low engine RPM. The delivery rate of the fuel 21 is customizable for any rate of delivery at any engine RPM.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tunable throttle plate assembly for customizing fuel delivery to a supercharged engine, said assembly comprising:

a plate configured to be coupled to intake manifold of an engine;

a fuel aperture extending through said plate;

a spray rod coupled to said fuel aperture;

a fuel nozzle coupled to said spray rod wherein said fuel nozzle delivers a fuel to said plate through said spray rod; and a solenoid coupled to said fuel nozzle, said solenoid being coupled to a fuel source wherein said solenoid delivers the fuel to said fuel nozzle;

wherein said fuel aperture extends through an outside edge and an inside side edge of said plate;

said fuel aperture comprising an outside portion having a diameter being greater than an inside portion of said fuel aperture;

an inside surface of said outside portion of said fuel aperture comprises threads;

wherein said fuel aperture is one of a plurality of said fuel apertures;

said plurality of fuel apertures comprising a plurality of sets of said fuel apertures; and a first set of said fuel apertures being evenly distributed along a first lateral side of said plate, a second set of said fuel apertures being evenly distributed along a front side of said plate, a third set of said fuel apertures being evenly distributed along a second lateral side of said plate, a fourth set of said fuel apertures being evenly distributed along a back side of said plate.

2. The assembly according to claim 1, further comprising an outside edge of said plate having four corners wherein said plate has a square shape.

3. The assembly according to claim 1, further comprising an inside edge of said plate defining an intake opening extending through a top side and a bottom side of said plate, said inside edge of said plate being coextensive with an outside edge of said plate wherein said intake opening has a square shape.

4. The assembly according to claim 1, wherein said plate is fluidly coupled to an intake manifold wherein a bottom side of said plate abuts a top of the intake manifold.

5. The assembly according to claim 1, wherein said spray rod comprises a tubular jet elongated along a longitudinal axis extending through a first end and a second end of said tubular jet.

6. The assembly according to claim 5, wherein said spray rod further comprises a tubular coupler elongated along a longitudinal axis extending through a first end and a second end of said tubular coupler.

7. The assembly according to claim 6, wherein said tubular coupler insertably receives said tubular jet wherein said first end of said tubular jet is positioned within said tubular coupler and said second end of said tubular jet is positioned outwardly from said round end of said tubular coupler wherein said tubular jet is retained within said tubular coupler.

8. The assembly according to claim 1, wherein said spray rod is one of a plurality of said spray rods.

9. The assembly according to claim 1, further comprising:

a delivery aperture extending through a first end and a second end of said fuel nozzle;

a central portion of said fuel nozzle having an outside diameter being greater than an outside diameter of each of a front and a rear portion of said fuel nozzle wherein said central portion of said fuel nozzle is configured to be gripped by a user; and said fuel nozzle being one of a plurality of said fuel nozzles.

10. The assembly according to claim 1, wherein a selected one of a plurality of said fuel nozzles is selectively positioned within a selected one of a plurality of said fuel apertures wherein an outside surface of a front portion of said fuel nozzle threadably engages an inside surface of an outside portion of the selected one of said plurality of fuel apertures wherein the selected one of said plurality of fuel nozzles is retained within the selected one of said plurality of said fuel apertures.

11. The assembly according to claim 1, wherein a delivery aperture insertably receives a first end of a tubular coupler wherein a flared portion of said spray rod is compressed between said fuel nozzle and an inside wall of a first portion of a selected one of a plurality of said fuel apertures wherein said spray rod is retained within the selected one of said plurality of said fuel apertures wherein said fuel nozzle is fluidly coupled to said spray rod.

12. The assembly according to claim 1, wherein said solenoid is selectively fluidly coupled to a selected number of a plurality of said fuel nozzles.

13. The assembly according to claim 1, wherein said solenoid is fluidly coupled to the fuel source.

14. A tunable throttle plate assembly for customizing fuel delivery to a supercharged engine, said assembly comprising:

a plate configured to be coupled to intake manifold of an engine;

a fuel aperture extending through said plate;

a spray rod coupled to said fuel aperture;

a fuel nozzle coupled to said spray rod wherein said fuel nozzle delivers a fuel to said plate through said spray rod;

a solenoid coupled to said fuel nozzle, said solenoid being coupled to a fuel source wherein said solenoid delivers the fuel to said fuel nozzle; and a selected one of a plurality of said spray rods being positionable within a selected one of a plurality of said fuel apertures extending through said plate wherein a flared portion of said spray rod abuts an inside wall of a first portion of the selected one of said plurality of fuel apertures wherein a second end of said tubular jet extends outwardly from a second portion of the selected one of said plurality of fuel apertures into an intake opening in said plate.

15. A tunable throttle plate assembly for customizing fuel delivery to a supercharged engine, said assembly comprising:

a plate configured to be coupled to an intake manifold of an engine, an outside edge of said plate having four corners wherein said plate has a square shape, an inside edge of said plate defining an intake opening extending through a top side and a bottom side of said plate, said inside edge of said plate being coextensive with said outside edge of said plate wherein said intake opening has a square shape, said plate being fluidly coupled to the intake manifold wherein said bottom side of said plate abuts a top of the intake manifold;

a fuel aperture extending through said outside edge and said inside side edge of said plate, said fuel aperture comprising an outside portion having a diameter being greater than an inside portion of said fuel aperture, an inside surface of said outside portion of said fuel aperture comprising threads;

said fuel aperture being one of a plurality of said fuel apertures, said plurality of fuel apertures comprising a plurality of sets of said fuel apertures, a first set of said fuel apertures being evenly distributed along a first lateral side of said plate, a second set of said fuel apertures being evenly distributed along a front side of said plate, a third set of said fuel apertures being evenly distributed along a second lateral side of said plate, a fourth set of said fuel apertures being evenly distributed along a back side of said plate;

a spray rod comprising a tubular jet, said tubular jet being elongated, said spray rod further comprising a tubular coupler, said tubular coupler being elongated, said tubular coupler insertably receiving said tubular jet wherein said first end of said tubular jet is positioned within said tubular coupler and said second end of said tubular jet is positioned outwardly from said second end of said tubular coupler wherein said tubular jet is retained within said tubular coupler;

said spray rod being one of a plurality of said spray rods, a selected one of said plurality of spray rods being positionable within a selected one of said plurality of fuel apertures extending through said plate wherein a flared portion of said spray rod abuts an inside wall of said first portion of the selected one of said plurality of fuel apertures wherein said second end of said tubular jet extends outwardly from said second portion of the selected one of said plurality of fuel apertures into said intake opening in said plate, a fuel nozzle comprising a delivery aperture extending through a first end and a second end of said fuel nozzle, a central portion of said fuel nozzle having an outside diameter being greater than an outside diameter of each of a front and a rear portion of said fuel nozzle wherein said central portion of said fuel nozzle is configured to be gripped by a user;

said fuel nozzle being one of a plurality of said fuel nozzles, a selected one of said plurality of fuel nozzles being selectively positioned within a selected one of said plurality of fuel apertures extending through said plate wherein an outside surface of said front portion of said fuel nozzle threadably engages said inside surface of said outside portion of the selected one of said plurality of fuel apertures wherein the selected one of said plurality of fuel nozzles is retained within the selected one of said plurality of said fuel apertures;

said delivery aperture on the selected one of the plurality of fuel nozzles insertably receiving said first end of an associated one of said plurality of tubular couplers wherein said flared portion of the associated one of said plurality of spray rods is compressed between said fuel nozzle and said inside wall of said first portion of an associated one of said plurality of fuel apertures wherein the selected one of said plurality of spray rods is retained within the associated one of said plurality of said fuel apertures wherein said fuel nozzle is selectively fluidly coupled to said spray rod; and a solenoid selectively fluidly coupled to a selected number of said plurality of fuel nozzles, said solenoid being fluidly coupled to the fuel source wherein said solenoid delivers the fuel to the selected number of said plurality of fuel nozzles, said solenoid being one of a plurality of said solenoids.

* * * * *